US007194883B2

(12) United States Patent
Bjuhr et al.

(10) Patent No.: US 7,194,883 B2
(45) Date of Patent: Mar. 27, 2007

(54) METHOD FOR FORMING OF TUBULAR WORK-PIECES USING A SEGMENTED TOOL

(75) Inventors: Jonas Bjuhr, Vetlanda (SE); Tomas Nilsson, Vetlanda (SE)

(73) Assignee: Sapa Profiler AB, Vetlanda (SE)

( * ) Notice: Subject to any disclaimer, the term of this patent is extended or adjusted under 35 U.S.C. 154(b) by 268 days.

(21) Appl. No.: 10/708,950

(22) Filed: Apr. 2, 2004

(65) Prior Publication Data

US 2004/0255629 A1 Dec. 23, 2004

Related U.S. Application Data

(60) Provisional application No. 60/481,308, filed on Aug. 29, 2003.

(30) Foreign Application Priority Data

Apr. 9, 2003 (SE) ..... 0301056-8

(51) Int. Cl.
*B21D 39/20* (2006.01)
*B21D 22/10* (2006.01)

(52) U.S. Cl. ..... 72/58; 72/60; 72/61; 72/57

(58) Field of Classification Search ..... 72/58, 72/60, 61, 57

See application file for complete search history.

(56) References Cited

U.S. PATENT DOCUMENTS

| | | | | |
|---|---|---|---|---|
| 4,763,503 A * | 8/1988 | Hughes et al. | ..... | 72/57 |
| 5,715,718 A * | 2/1998 | Rigsby et al. | ..... | 72/57 |
| 6,584,821 B1 * | 7/2003 | Ghiran et al. | ..... | 72/58 |
| 6,889,535 B1 * | 5/2005 | Ericson | ..... | 72/61 |

* cited by examiner

*Primary Examiner*—David Jones
(74) *Attorney, Agent, or Firm*—Drinker Biddle & Reath LLP

(57) ABSTRACT

The hydroforming tool of the present invention comprises a pair of upper and lower tool inserts having open axial ends and defining an elongated cavity there between when the tool inserts are forced together. The upper and/or lower tool inserts are composed of segments that are attached to the upper and a lower base plates, by bolts. Retaining elements, such as pins, are introduced into holes in the base plates and continues into cavities formed in the segmented inserts. This prevents the insert segments from moving during the forming operation. In this way the use of base blocks may be omitted. Sometimes the friction force acting between the base plate and segmented inserts, caused by the high pressure applied to the tool surfaces, is sufficient to prevent the separation of the segments, whereby the segments are kept in place without the use of retaining elements.

13 Claims, 1 Drawing Sheet

METHOD FOR FORMING OF TUBULAR WORK-PIECES USING A SEGMENTED TOOL

CROSS REFERENCE TO RELATED APPLICATIONS

This application claims the benefit of a U.S. Provisional Application No. 60/481,308, filed on Aug. 29, 2003.

BACKGROUND OF INVENTION

The invention relates to the forming of tubular workpieces by internal pressure created by a fluid, i e hydroforming, and in particular to a segmented tool used for said forming operation.

The hydroforming process is described in "Hydroforming—Umformen mit Wirkmedien im Automobilbau, Verlag Moderne Industrie, Landsberg, 2002". In this process tubes formed to final shape by insertion in a tool where the tubes are expanded by applying an internal pressure to the inside of the tube using a fluid. The tubes may be straight or pre-bent depending on the final requirements.

Hydroforming of large work-pieces, such as sidemembers for car body structures presents significant problems due to the difficulty of handling the very heavy tools that are required as moulds during forming. For this reason segmented tool inserts, i e tools that consists of two or more parts, are sometimes used, which considerably facilitates the handling and makes it possible to exchange parts of the inserts if the insert has been damaged or worn, without replacing the whole tool. To keep the segments in place the tool insert is surrounded by a base block, with tight tolerances to the segmented inserts. The base block may be manufactured in one part or may comprise a base and vertical supports fixed to it. The disadvantage of this arrangement is the high cost for the base blocks and the fact that these base blocks are even heavier and more difficult to handle than single piece inserts. The problems connected with the use of large toolings become particularly pronounced when small series or prototypes are manufactured, which means that the tool has to be replaced frequently. The problem is discussed in "Innenhochdruck-Umformen fur Karosseriekomponenten, 3. Chemnitzer Karosseriekolloquium, CBC 2002, Verlag Wissenschaftliche Scripten, Zwickau", page 62, where it is suggested that tools for prototypes are manufactured by forming a cavity directly in a single piece of metal and simplified in the sense that no inserts are used. This does not make handling of the tool easier and no possibility to exchange a part of the tool is possible.

In "Hydroforming-Umformen mit Wirkmedien im Automobilbau" segmented inserts are mentioned, but always in combination with base blocks that keep the segments from separating during forming.

SUMMARY OF INVENTION

An object of the present invention is to provide a simplified tool for hydroforming of tubular work-pieces, where the use of very large tooling blocks can be prevented. The invention is particularly useful when small series or prototypes are manufactured.

According to a first aspect of the present invention a tool comprising a pair of upper and lower tool inserts having open axial ends and defining an elongated cavity there between when said tool inserts are forced together. The upper and/or lower tool inserts are composed of segments that are attached to the upper and a lower base plates by bolts. Retaining elements, such as pins, are introduced into holes in the base plates from where they extend thorough the base plate and continue into cavities formed in the segmented insert (or extend from the insert into holes in the baseplate). This prevents the insert segments from moving during the forming operation. The retaining elements normally have a round or a conical shape for easier guidance into the cavities and a tight tolerance to the cavities to minimise movement of the segments. In this way the use of base blocks may be omitted.

To guide the tool inserts to the desired position on the base plate guide columns are used. The guide columns are attached to the upper base plate and extend through the base plate and the insert. By lowering the upper tool punch vertically towards the lower base plate the guide columns from the upper tool half are introduced into spaces in the lower half of the insert. The guide columns and the retaining elements may also be attached or form part of the inserts and extend through the base plate into theThe retaining elements may act as guide columns, or separate guide columns may be used. The tolerances, however, has to be tight between pin and the hole in the base plate to assure the non-movement of the insert segments.

According to a second aspect of the invention the friction force between the base plate and the insert may be high enough to prevent axial movement of the segments, and in this case the retaining elements may be omitted.

A pair of mandrels adjacent the axial open ends of the elongated cavity retain the tubular work-piece in the cavity and forms a sealed closure of the ends of the tubular work-piece. Work-piece material is forced axially inwardly during forming of the work-piece and hydroforming liquid is entered through the mandrel into the work-piece for hydroforming the work-piece into the final shape. The pressurising of the work-piece may be done either before of after the closure of the tool.

The method of the present invention allows the elimination of the very large and heavy base blocks that has been a prerequisite in previously used methods. In this way production times may be shortened and the costs reduced.

DETAILED DESCRIPTION

Figure 1:
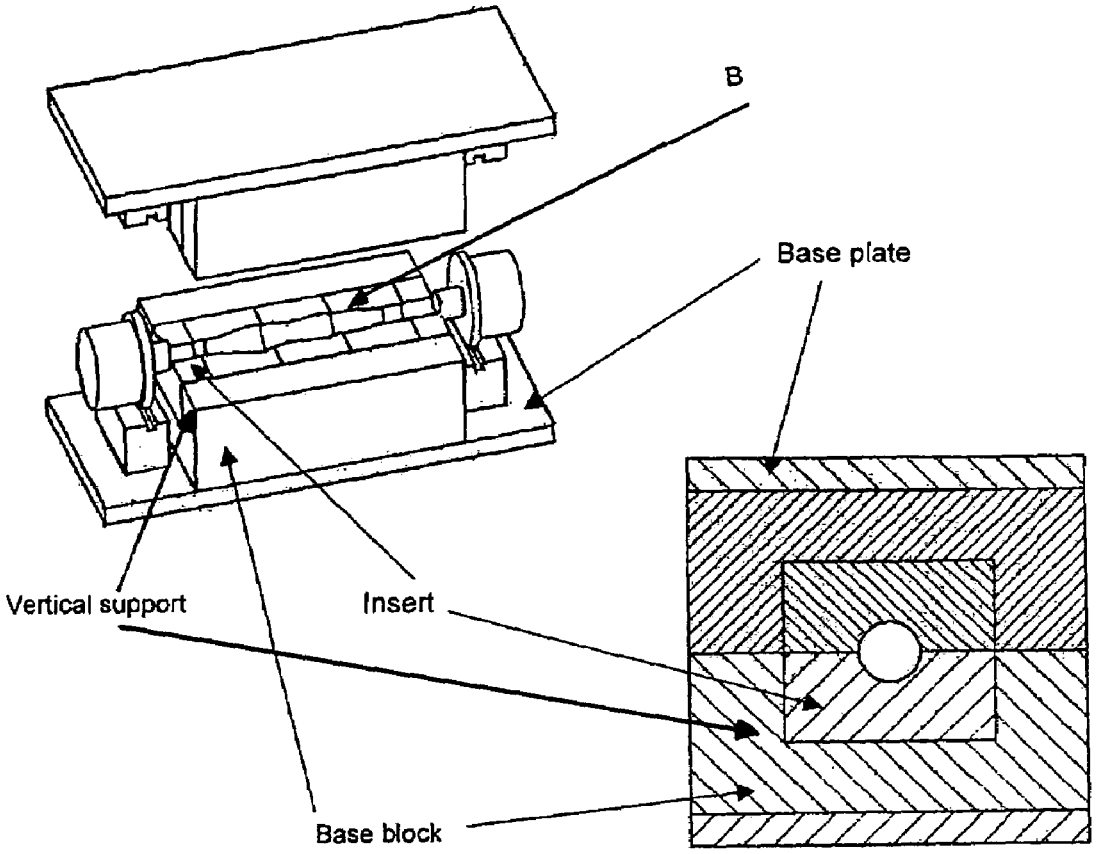
Figure 1 (Prior Art)
FIG. 1 is a plan view of a hydroforming tool according to the prior art.

In FIG. 1 a segmented tool according to the state of the art is shown. Vertical supports (V) fixed to the base block, prevents movement of the segments.

Figure 2:
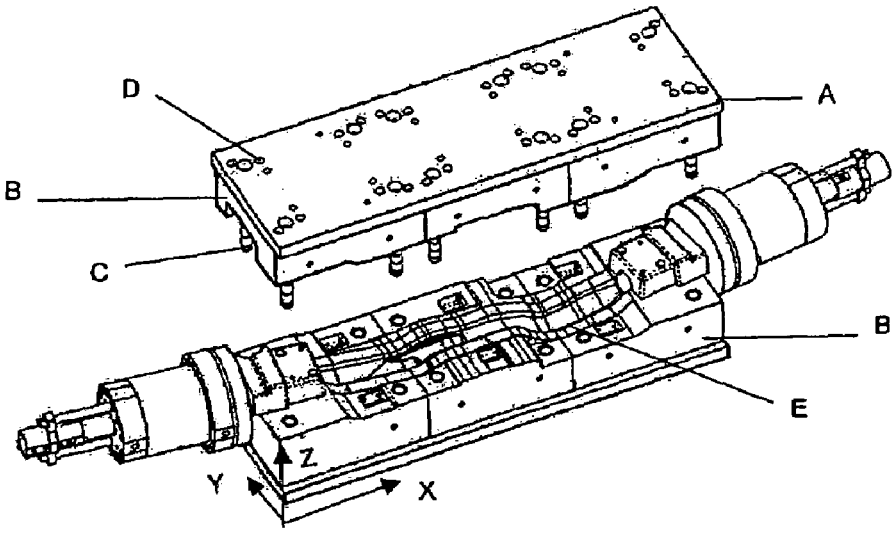
FIG. 2 is a plan view of a hydroforming tool according to the invention.

Referring to FIG. 2, a hydroforming tool comprising a base plate (A) and a segmented insert (B), having through holes for guide columns (C) and smaller diameter holes (D) for the retaining elements (pins not shown in FIGURE). The retaining elements are snugly fitted into the base plate, which makes attachment of the elements superfluous. As can be seen the tool is free from vertical supports acting on the outer surface of the insert.

When the upper tool half is lowered, the guide columnsassure the guiding of the tool parts to their exact position. When pressure is applied to the hydroforming liquid, high forces act on the tool parts, some of these in directions that would cause separation of the segments of the inserts if no opposed forces counteract them. The retaining elements or sometimes, depending on the dimension and shape of the workpiece, only the friction force acting between the base plate and segmented inserts caused by the high pressure applied to the tool surfaces, will prevent the separation of the segments. There is thereby no need for vertical supports acting on the outer surfaces of the insert.

The number of segments may be varied freely, it is however common for the number of segments to exceed two.

In particular, the invention provides a method of hydroforming hollow work-pieces by providing a pair of upper and lower tool inserts (B) having open axial ends and defining an elongated cavity (E) there between when said tool inserts are forced together, said upper and/or lower tool inserts being composed of at least two segments that are in a locked position in all directions (X, Y, Z) during the forming of the work-piece and in contact with a base plate (A) on the side opposite to the cavity and a) providing a hollow work-piece in said cavity;

b) sealing the ends of the hollow work-piece;

c) filling said work-piece with liquid;

d) applying an internal pressure to the inside of the work-piece by increasing the pressure on said liquid;

e) moving said upper and lower tool inserts together to deform portions of the work-piece at any time after step a), where themovementofsaid segments in the X- and the Y-direction is prevented by other means than by using vertical supports acting on the outer surfaces of the inserts.

EXAMPLE 1

A hydroforming tool comprising an upper punch, base plates with a pair of upper and lower tool inserts attached to them is used for forming of a tubular work-piece made from extruded aluminium. The inserts have open axial ends and define an elongated cavity between them when the tool is closed. The inserts are each composed of at least two segments that are screwed onto the base plates. Retaining elements are introduced into holes in the base plate and partially through the segments of the inserts. Guide columns extending through and from the base plates are introduced into cavities formed in the segmented inserts when the upper punch is lowered.

A tubular work-piece was put in said cavity and the upper and lower tool inserts moved together to deform portions of the work-piece. The ends of the tubular work-piece were sealed and the work-piece filled with liquid through an inlet in the mandrels while supplying work-piece material axially inwardly.

Pressure was then applied to the inside of the work-piece by increasing the pressure on said liquid. The cavities in the base plates have a tight tolerance to the retaining elements, so that the movement of the segment during forming is as low as possible. The tool was opened and the formed pieces removed. No marks could be found on the work-piece to indicate that a movement of the segments had taken place. When a number of tubes have been formed the tool insert was replaced by removing each segment separately.

EXAMPLE 2

A hydroforming tool as in example 1, but without retaining elements, is used for forming a tubular work-piece made from extruded aluminium. The tubular work-piece is put in said cavity and the upper and lower tool inserts are moved together to deform portions of the work-piece while supplying work-piece material axially inwardly. Pressure of 1500 tonnes is applied to the tool parts by the tool punch. Pressure is then applied to the inside of the work-piece by increasing the pressure on said liquid to 1000 bar. The tool is opened and the formed pieces are removed. No movement of the segments could be observed.

The invention claimed is:

1. A method of hydroforming hollow work-pieces by providing a pair of upper and lower tool inserts having open axial ends and defining an elongated cavity there between when said tool inserts are forced together in a Z-direction by means of a tool punch, said upper and/or lower tool inserts being composed of at least two segments that are in a locked position relative to a base plate during the forming of the work-piece and a) providing a hollow work-piece in said cavity;

b) sealing the ends of the hollow work-piece;

c) filling said work-piece with liquid;

d) applying an internal pressure to the inside of the work-piece by increasing the pressure on said liquid; and e) moving said upper and lower tool inserts together to deform portions of the work-piece at any time after step a), wherein said inserts are in contact with said base plate on the side opposite to the elongated cavity and movement of said segments in the X- and the Y-direction is prevented by other means than by using vertical supports acting on outer surfaces of the inserts.

2. Method according to claim 1, wherein the movement of the segments is prevented by retaining elements extending from said base plate into cavities formed in said segments on the opposite side of the elongated cavity, said cavities being adapted to receive said retaining elements.

3. Method according to claim 1, wherein the movement of the segments is prevented by retaining elements extending from said segments into cavities formed in said base plate on the opposite side of the elongated cavity, said cavities being adapted to receive said retaining elements.

4. Method according to claim 1, wherein the segments are guided onto the upper and the lower base blocks plates by guide columns.

5. Method according to claim 3, wherein the retaining elements act as said guide columns.

6. Method according to claim 1, wherein the segments are kept in a fixed position mainly by friction forces acting between the base plate and the insert.

7. A tool for hydroforming a hollow work-piece comprising a pair of upper and lower tool inserts having open axial ends and defining an elongated cavity there between when said tool inserts are forced together by means of a tool punch in the Z-direction, said upper and/or lower tool inserts each being composed of segments that are in a locked position in relation to a lower base plate wherein said inserts are in contact with said upper and lower base plate, said tool being free from vertical supports acting on outer surfaces of the insert to prevent movement thereof in the X- and the Y-direction.

8. A tool for hydroforming a hollow work-piece according to claim 7, wherein a plurality of retaining elements for preventing movement of the segments extend from said segments into cavities formed in said base plates, said cavities being adapted to receive said retaining elements.

9. A tool for hydroforming a hollow work-piece according to claim 7, wherein the segments are guided onto the upper and the lower base plates by guide columns extending from said base plates.

10. A tool for hydroforming a hollow work-piece according to claim 7, wherein the upper and the lower base plates are guided onto the segments by guide columns extending from said segments.

11. A tool for hydroforming a hollow work-piece, comprising a pair of upper and lower tool inserts having open axial ends and defining an elongated cavity there between when said tool inserts are forced together by means of a tool punch in the Z-direction, said upper and/or lower tool inserts each being composed of segments that are in a locked position in relation to a lower base plate, wherein retaining elements preventing movement of the segments extend from said base plates into cavities formed in said segments, said cavities being adapted to receive said retaining elements, said inserts are in contact with said upper and lower base plate.

12. A tool for hydroforming a hollow work-piece according to claim 11, wherein the retaining elements also act as said guide columns.

13. A tool for hydroforming a hollow work-piece according to claim 11, wherein the retaining elements are in the shape of pins.

* * * * *